US005530984A

United States Patent [19]

Walker

[11] Patent Number: 5,530,984

[45] Date of Patent: Jul. 2, 1996

[54] QUICK WIPE ERASER FOR CHALKBOARDS

[76] Inventor: William E. Walker, 364 Oriole Trail, Crystal Lake, Ill. 60014

[21] Appl. No.: 521,876

[22] Filed: Aug. 31, 1995

[51] Int. Cl.[6] ..... A47L 13/10

[52] U.S. Cl. ..... 15/209.1; 15/424; 15/145; 15/147.2

[58] Field of Search ..... 15/209.1, 424, 15/145, 154, 147.2, 210.1, 227, 229.3, 229.5, 143.1; D8/107

[56] References Cited

U.S. PATENT DOCUMENTS

| | | | |
|---|---|---|---|
| 4,529 | 8/1871 | Charles | 15/209.1 |
| 188,227 | 3/1877 | Bacon | 15/209.1 |
| 1,437,145 | 11/1922 | Johnson | 15/229.3 |
| 2,068,162 | 1/1937 | Borchers | 15/227 |
| 2,691,185 | 10/1954 | Jones | 15/227 |
| 2,802,229 | 8/1957 | Bangs | 15/143.1 |
| 3,005,220 | 10/1961 | McPherson | 15/147.2 |
| 3,152,348 | 10/1964 | Zelinkoff | 15/147.2 |
| 3,797,061 | 3/1974 | Statler | 15/223 |
| 3,986,224 | 10/1976 | Yang | 15/223 |
| 4,467,492 | 8/1984 | Harrington | 15/143.1 |
| 4,596,059 | 6/1986 | Lee | 15/221 |
| 4,742,594 | 5/1988 | Chen | 15/221 |
| 4,800,609 | 1/1989 | Peck | 15/210.1 |
| 5,012,544 | 5/1991 | Verry | 15/209.1 |
| 5,099,541 | 3/1992 | Tressler | 15/244.1 |
| 5,216,776 | 6/1993 | Dennison | 15/312.1 |

*Primary Examiner*—David Scherbel
*Assistant Examiner*—James F. Hook

[57] ABSTRACT

An eraser is disclosed. The eraser includes a frame formed of tubular components coupled together. The frame includes a first peripheral member having long parallel side edges, a short rear edge and a triangular shaped front edge. The side edges are about twice the length of the rear edge. Three cross-brace members including a front cross-brace member constitute the base of the triangle. Additional cross-brace members are at equally spaced locations on the interior faces of the side edges. A handle is formed of a rod extending upwardly from the central extent of the forward cross brace. The handle extends rearwardly at a right angle to and over the central cross brace member with a plastic grip member of an enlarged diameter with finger receiving recesses on its lower extent secured to the end of the handle remote from the frame. A flexible cover is secured over the lower surface of the frame and is essentially co-extensive therewith.

1 Claim, 3 Drawing Sheets

QUICK WIPE ERASER FOR CHALKBOARDS

BACKGROUND OF THE INVENTION

1. Field of the Invention

The present invention relates to a quick wipe eraser for chalkboards and, more particularly, pertains to erasing chalk from a chalkboard through a frame having a readily removable erasing surface.

2. Description of the Prior Art

The use of erasers of various designs and configurations is known in the prior art. More specifically, erasers of various designs and configurations heretofore devised and utilized for the purpose of eradicating marks from surfaces through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,797,061 to Statler discloses a blackboard eraser.

U.S. Pat. No. 3,986,224 to Yang discloses an eraser with dust-collecting means.

U.S. Pat. No. 4,596,059 to Lee discloses an automatic dust removing eraser of a rolling friction type for blackboard.

U.S. Pat. No. 4,742,594 to Chen discloses a blackboard eraser with brushes and rollers.

U.S. Pat. No. 5,099,541 to Tressler discloses a blackboard eraser apparatus with a removable lid.

Lastly, U.S. Pat. No. 5,216,776 to Dennison discloses an automatic blackboard eraser apparatus with a track structure and drive motor.

In this respect, the quick wipe eraser for chalkboards according to the present invention substantially departs from the conventional concepts and designs of the prior art, and in so doing provides an apparatus primarily developed for the purpose of erasing chalk from a chalkboard through a frame having a readily removable erasing surface.

Therefore, it can be appreciated that there exists a continuing need for a new and improved quick wipe eraser for chalkboards which can be used for erasing chalk from a chalkboard through a frame having a readily removable erasing surface. In this regard, the present invention substantially fulfills this need.

SUMMARY OF THE INVENTION

In view of the foregoing disadvantages inherent in the known types of erasers of various designs and configurations now present in the prior art, the present invention provides an improved quick wipe eraser for chalkboards. As such, the general purpose of the present invention, which will be described subsequently in greater detail, is to provide a new and improved quick wipe eraser for chalkboards and method which has all the advantages of the prior art and none of the disadvantages.

To attain this, the present invention essentially comprises a new and improved quick wipe eraser for chalkboards comprising, in combination, a frame formed of tubular components coupled together and including a first peripheral member having long parallel side edges, a short rear edge and a triangular shaped front edge, the side edges being about twice the length of the rear edge and the triangle having three essentially equal 60 degree angles; three cross-brace members including a front cross-brace member constituting the base of the triangle and having two additional cross-brace members at equally spaced locations on the interior faces of the side edges; a handle formed of a rod extending upwardly from the central extent of the forward cross brace and extending rearwardly at a right angle to and over the central cross brace member with a plastic grip member of an enlarged diameter with finger receiving recesses on its lower extent secured to the end of the handle remote from the frame; a flexible cover secured over the lower surface of the frame and essentially co-extensive therewith with side edges and with an upper surface secured with respect to the upper surface of the frame, the upper surface being formed with a longitudinal slit from adjacent the triangle to the opposite end thereof, the opposite end of the cover being open to facilitate coupling to the frame, the fabric being formed of a felt with a knap extending downwardly away from the frame for erasing chalk from a chalkboard; and a connector strap at a side edge of the cover adjacent to the rear end of the cover and a connector strap at a side edge of the cover adjacent to the triangle with patches of pile-type fastener secured to the ends of the straps and with mutually coupleable pile-type fasteners on the rear surface of the cover to removably join with the pile-type fasteners of the straps for maintaining the cover in position on the frame.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved quick wipe eraser for chalkboards which has all the advantages of the prior art erasers of various designs and configurations and none of the disadvantages.

It is another object of the present invention to provide a new and improved quick wipe eraser for chalkboards which may be easily and efficiently manufactured and marketed.

It is a further object of the present invention to provide a new and improved quick wipe eraser for chalkboards which is of a durable and reliable construction.

An even further object of the present invention is to provide a new and improved quick wipe eraser for chalkboards which is susceptible of a low cost of manufacture with regard to both materials and labor, and which accordingly is then susceptible of low prices of sale to the consuming public, thereby making such erasers of various designs and configurations economically available to the buying public.

Still yet another object of the present invention is to provide a new and improved quick wipe eraser for chalkboards which provides in the apparatuses and methods of the prior art some of the advantages thereof, while simultaneously overcoming some of the disadvantages normally associated therewith.

Even still another object of the present invention is to erasing chalk from a chalkboard through a frame having a readily removable erasing surface.

Lastly, it is an object of the present invention to provide an eraser. The eraser includes a frame formed of tubular components coupled together. The frame includes a first peripheral member having long parallel side edges, a short rear edge and a triangular shaped front edge. The side edges are about twice the length of the rear edge. Three cross-brace members including a front cross-brace member constitute the base of the triangle. Additional cross-brace members are at equally spaced locations on the interior faces of the side edges. A handle is formed of a rod extending upwardly from the central extent of the forward cross brace. The handle extends rearwardly at a right angle to and over the central cross brace member with a plastic grip member of an enlarged diameter with finger receiving recesses on its lower extent secured to the end of the handle remote from the frame. A flexible cover is secured over the lower surface of the frame and is essentially co-extensive therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
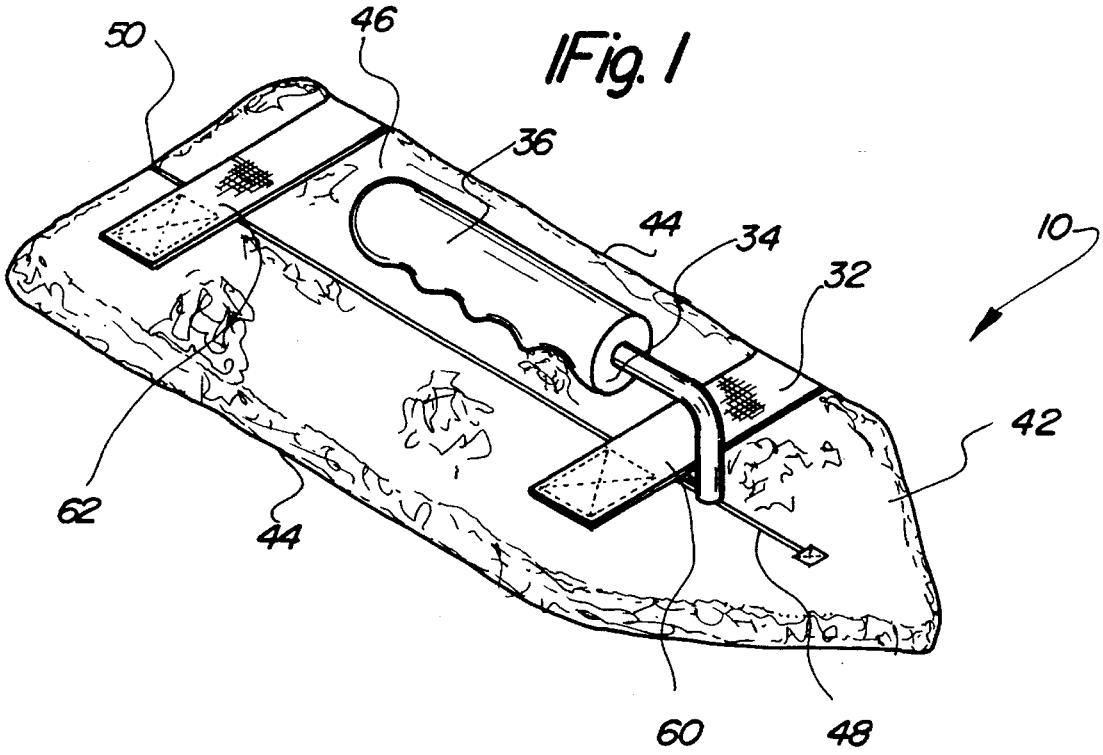
FIG. 1 is a perspective illustration of the preferred embodiment of the new and improved quick wipe eraser for chalkboards constructed in accordance with the principles of the present invention.
Figure 2:
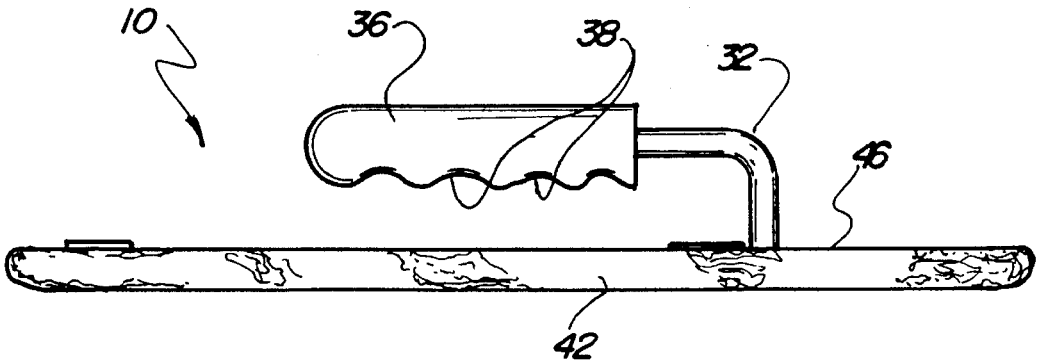
FIG. 2 is a side elevational view of the device shown in FIG. 1.
Figure 3:
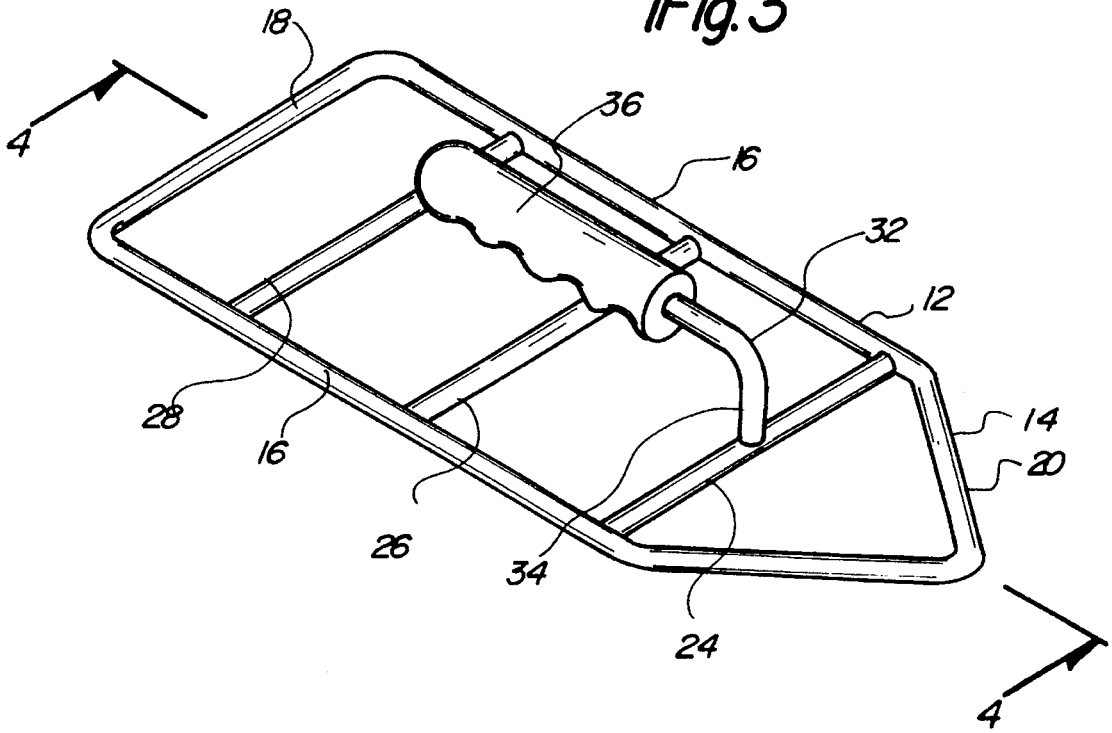
FIG. 3 is a perspective illustration similar to FIG. 1 but with the cover removed.
Figure 4:
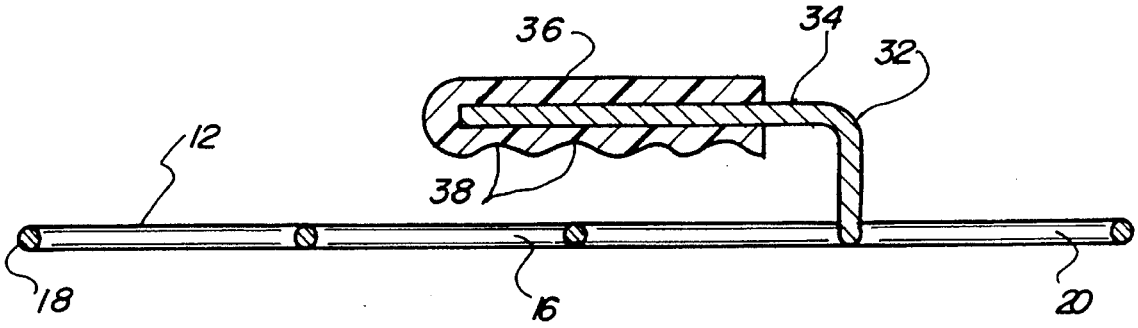
FIG. 4 is a cross-sectional view taken along line 4—4 of FIG. 3.
Figure 6:
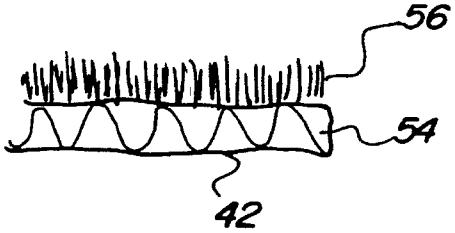
FIG. 6 is a cross-sectional view taken along line 6—6 of FIG. 5.
Figure 5:
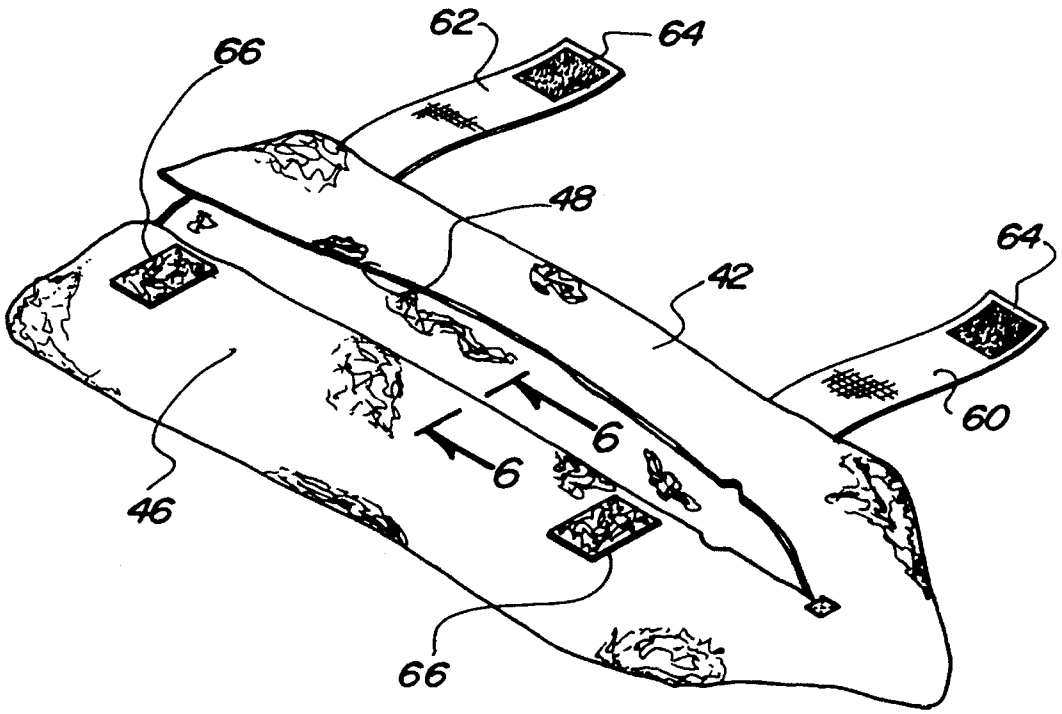
FIG. 5 is a perspective view of the cover per se.

With reference now to the drawings, and in particular to FIG. 1 thereof, the preferred embodiment of the new and improved quick wipe eraser for chalkboards embodying the principles and concepts of the present invention and generally designated by the reference numeral 10 will be described.

The present invention, the new and improved quick wipe eraser for chalkboards, is a system 10 comprised of a plurality of components. In their broadest context, the components include a frame, cross-brace members, a handle, a flexible cover, and connector straps. Each of the individual components is specifically configured and correlated one with respect to the other so as to attain the desired objectives.

The present invention is in the form of a system 10 which has as its central component a frame 12. The frame is formed of tubular components coupled together and including a first peripheral member 14 having long parallel side edges 16. It also has a short rear edge 18. It also has a triangularly-shaped front edge 20. The side edges are about twice the length of the rear edge. The triangular front has three essentially equal 60 degree angles.

Support for the frame is provided by including three cross-brace members. Such cross-brace members include a front cross-brace member 24 which constitutes the base of the triangle. There are two additional cross-brace members 26,28. They are located at equally spaced locations on the interior faces of the side edges.

Next provided is a handle 32. The handle is formed of a rod 34 extending upwardly from the central extent of the forward cross-brace member. It extends rearwardly at a right angle to and over the central cross-brace member with a plastic grip member 36 provided. The plastic grip member is of an enlarged diameter with a cylindrical recess to receive the rod. The grip is formed with finger receiving recesses 38 on its lower extent. It is secured to the end of the handle remote from the frame by being slidingly press fit thereon.

Next provided is a flexible cover 42. The flexible cover is secured over the lower surface of the frame. It is essentially co-extensive with the lower surface of the frame. It has side edges 44 and also has an upper surface 46. The upper surface is secured with respect to the upper surface of the frame. The upper surface of the cover is formed with a longitudinal slit 48. Such slit extends from adjacent the triangle to the opposite free end 50 thereof. The opposite free end of the cover is open to facilitate coupling of the cover to the frame.

The fabric is preferably formed of a felt material 54 with a knap 56 on the lower surface thereof. The knap extends downwardly away from the frame for erasing chalk from a chalkboard.

Lastly provided are a plurality of connector straps. Such straps include a first connector strap 60 coupled adjacent to a side edge of the cover adjacent to the rear end of the cover. An additional connector strap 62 is located at the side edge of the cover adjacent to the triangle. Patches 64 of pile-type fastener are secured to the free ends of the straps. In association therewith mutually coupleable pile-type fasteners 66 are secured to the rear surface of the cover on the side thereof remote from the slit. The pile-type fasteners of the straps are coupled with the additional pile-type fasteners on the cover to removably join with respect to each other. Their function is to maintain the cover in proper position on the frame.

The present invention is an implement which can be used to erase a chalkboard much more quickly and effectively than the commonly used felt eraser.

It is simply comprised of a frame, the erasing cover and a handle. The frame is made of metallic rod sections which are ¼ of an inch in diameter. The shape of the frame is similar to that of the bottom face of an iron, and it is 16 inches long by 4 inches wide; three cross members serve to stabilize the frame. The cover, or mop head, is made of wool in a similar shape and retained on the frame with hook and loop material strips. In profile, the implement resembles a trowel and has a 5 inch long dowel-like handle.

From the foregoing description, the use of this novel and functional eraser becomes fairly obvious; however, the key to its effectiveness and longevity lies in the treatment of the mop head. This is done simply by applying a mop conditioner each day.

The board can be wiped clean with one swipe and multiple and overlapping strokes are not required. Further, the pointed end of the eraser facilitates easy access to the corners of the board, and the mop head will retain dust for an entire day. Maintenance is also simple in that the mop head need only be washed approximately once a week. It can be brushed and treated once a day and this only for extensive use of the eraser. This eraser should be a boon to anyone obligated to work with chalkboards.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved quick wipe eraser for chalkboards comprising, in combination:

a frame formed of tubular components coupled together and including a first peripheral member having long parallel side edges, a short rear edge and a front angled edge that connects to the two side edges integrally as well as the rear edge, the side edges being about twice the length of the rear edge and the triangle having three essentially equal 60 degree angles;

three cross-brace members including a front cross-brace member constituting the base of the triangle and having two additional cross-brace members at equally spaced locations on the interior faces of the side edges;

a handle formed of a rod extending upwardly from the central extent of the forward cross brace and extending rearwardly at a right angle to and over the central cross brace member with a plastic grip member of an enlarged diameter with finger receiving recesses on its lower extent secured to the end of the handle remote from the frame;

a flexible cover secured over the lower surface of the frame and essentially co-extensive therewith with side edges and with an upper surface secured with respect to the upper surface of the frame, the upper surface being formed with a longitudinal slit from adjacent the triangle to the opposite end thereof, the opposite end of the cover being open to facilitate coupling to the frame, the fabric being formed of a felt with a knap extending downwardly away from the frame for erasing chalk from a chalkboard; and a connector strap at a side edge of the cover adjacent to the rear end of the cover and a connector strap at a side edge of the cover adjacent to the triangle with patches of pile-type fastener secured to the ends of the straps and with mutually coupleable pile-type fasteners on the rear surface of the cover to removably join with the pile-type fasteners of the straps for maintaining the cover in position on the frame.

* * * * *